US007216822B2

(12) United States Patent
Stehr et al.

(10) Patent No.: US 7,216,822 B2
(45) Date of Patent: May 15, 2007

(54) AGITATOR MILL

(75) Inventors: Norbert Stehr, Grunstadt (DE); Philipp Schmitt, Lampertheim (DE)

(73) Assignee: Bühler AG, Uzwil (CH)

( * ) Notice: Subject to any disclaimer, the term of this patent is extended or adjusted under 35 U.S.C. 154(b) by 131 days.

(21) Appl. No.: 11/171,319

(22) Filed: Jul. 1, 2005

(65) Prior Publication Data

US 2006/0261200 A1 Nov. 23, 2006

(30) Foreign Application Priority Data

May 19, 2005 (EP) ..... 05010815

(51) Int. Cl.
*B02C 17/16* (2006.01)

(52) U.S. Cl. ..... 241/171; 241/152.1; 241/153; 241/170; 241/172; 241/179

(58) Field of Classification Search ..... 241/152.1, 241/153, 170, 171, 172, 179
See application file for complete search history.

(56) References Cited

U.S. PATENT DOCUMENTS 5,133,508 A * 7/1992 Stehr et al. ..... 241/171
5,897,068 A * 4/1999 Stehr ..... 241/171
5,950,943 A * 9/1999 Stehr ..... 241/171
5,996,914 A * 12/1999 Stehr ..... 241/171
6,021,969 A * 2/2000 Schmitt et al. ..... 241/171

* cited by examiner

*Primary Examiner*—Lowell A. Larson
*Assistant Examiner*—Jason Y Pahng
(74) *Attorney, Agent, or Firm*—Browdy and Neimark, PLLC

(57) ABSTRACT

An agitator mill comprises an annular cylindrical exterior grinding chamber which is defined by an inner wall of a grinding receptacle and an outer wall of a rotor; and an interior grinding chamber which is defined by an inner wall of the rotor and an outer casing of an interior stator. The grinding chambers are interconnected by a deflection chamber. g<h applies to the radial gap width g of the exterior grinding chamber in relation to the radial gap width h of the interior grinding chamber.

24 Claims, 12 Drawing Sheets

AGITATOR MILL

BACKGROUND OF THE INVENTION

1. Field of the Invention

The invention relates to an agitator mill for treating free-flowing grinding stock, comprising a grinding receptacle which defines a substantially closed grinding chamber by means of an inner wall; and an agitator which is rotarily drivably disposed therein and which is cup-shaped in relation to a common central longitudinal axis, having an annular cylindrical rotor which has a closed wall; and an interior stator which is disposed within the rotor and fixedly joined to the grinding receptacle; wherein an annular cylindrical exterior grinding chamber in the form of an annular gap is formed between the inner wall of the grinding receptacle and an outer wall of the rotor, the exterior grinding chamber having a radial gap width; and an annular cylindrical interior grinding chamber in the form of an annular gap is formed between an inner wall of the rotor and an outer casing of the interior stator, the interior grinding chamber being arranged coaxially within the exterior grinding chamber and connected thereto via a deflection chamber and having a radial gap width h; wherein the exterior grinding chamber, the deflection chamber and the interior grinding chamber constitute the grinding chamber which is partially filled with auxiliary grinding bodies; wherein a grinding-stock supply area, which is disposed upstream of the exterior grinding chamber and opens into it in the direction of flow of the grinding stock, and a separator device, which is disposed downstream of the interior grinding chamber in the direction of flow, are disposed approximately on the same side of the grinding receptacle for the grinding stock to pass through; wherein auxiliary-grinding-body return conduits are provided in the agitator for returning the auxiliary grinding bodies from the vicinity of the separator device into the grinding-stock supply area, the return conduits connecting the end of the interior grinding chamber to the beginning of the exterior grinding chamber; and wherein the inner wall of the grinding receptacle and the outer wall and the inner wall of the rotor are free of interruptions, and the inner wall of the grinding receptacle and the outer wall of the rotor are smooth and free of agitator implements.

2. Background Art

In an agitator mill of the generic type known from U.S. Pat. No. 5,950,943 the interior grinding chamber as well as the exterior grinding chamber are smooth-walled without any interruptions and free from agitator elements. The gap width i.e., the radial extension of the exterior grinding chamber, distinctly exceeds that of the interior grinding chamber. This is meant to accomplish that grinding and dispersing the free-flowing, slurried grinding stock takes place predominantly by shearing effects in such a way that the local intensity of strain on the grinding stock is substantially constant throughout the entire grinding length of path. The smooth-walled design of the cylindrical boundary walls of the exterior grinding chamber and the interior grinding chamber produces a flow in which the auxiliary grinding bodies are moved relative to each other in layers. The shearing gradient and thus the local intensity of strain is constant over the respective grinding-chamber height in the exterior grinding chamber on the one hand and in the interior grinding chamber on the other. With the gap width of the interior grinding chamber being smaller than the gap width of the exterior grinding chamber, the shearing gradient can be made equal in the exterior grinding chamber and in the interior grinding chamber; it is then virtually constant throughout the grinding chamber. Problems have turned out to be posed by the fact that start-up of the agitator mill is difficult in the case of a high auxiliary-grinding-body fill factor. Because of its start-up problems the agitator mill is operated at a reduced auxiliary-grinding-body fill, which again leads to unfavorably rough distribution in grinding-stock particle size. Since this reduction of auxiliary grinding bodies reduces the amount of auxiliary grinding bodies that return through the auxiliary-grinding-body return conduits, there is an increase in the risk of so-called grinding-stock shooting flow i.e., grinding stock that has been supplied to the grinding-stock supply chamber for being ground or dispersed may short-circuit through the auxiliary-grinding-body return conduits towards the separator device.

SUMMARY OF THE INVENTION

It is an object of the invention to embody an agitator mill of the generic type in such a way that start-up of the agitator mill is facilitated and fine distribution of grinding-stock particle size is obtained.

According to the invention, this object is attained by $g<h$ applying to the radial gap width g of the exterior grinding chamber in relation to the radial gap width h of the interior grinding chamber. The measures according to the invention help to ensure that, when the agitator mill is switched off, the auxiliary grinding bodies that deposit downwards do not stick together with the adjacent walls in particular in the interior grinding chamber. Upon start-up of the agitator mill, the auxiliary grinding bodies can therefore be set moving easily. The measures according to the invention further ensure that there is no accumulation of the auxiliary grinding bodies in the exterior grinding chamber in front of the interior grinding chamber, because the gap width of the interior grinding chamber exceeds that of the exterior grinding chamber. Grinding by shearing takes place in the exterior grinding chamber. With the auxiliary grinding bodies tending to escape from increased shearing action, they flow into the interior grinding chamber through the deflection chamber which expands towards the interior grinding chamber. Owing to the described effects, the agitator mill can be run at a high fill ratio of auxiliary grinding bodies i.e, the fill of auxiliary grinding bodies need not be reduced. This leads to especially intensive grinding while avoiding grinding-stock shooting flows, because sufficient quantities of auxiliary grinding bodies are returned through the auxiliary-grinding-body return conduits.

The effects which the invention aims at are influenced particularly favorably by the feature wherein $Fa \leqq Fb$, and preferably $1.2\ Fa \leqq Fb \leqq 7\ Fa$, applies to the cross-sectional area Fa of the exterior grinding chamber in relation to the cross-sectional area Fb of the interior grinding chamber. This is still supported by the development wherein $g \geqq 3\ i$ applies to the gap width g of the exterior grinding chamber in relation to the diameter i of the biggest auxiliary grinding bodies in the grinding chamber; wherein $i \leqq 3.0$ mm, and preferably $i \leqq 1.5$ mm, applies to the diameter i of the auxiliary grinding bodies; and wherein $g \leqq 9.0$ mm, and preferably $g \leqq 5.0$ mm applies to the gap width of the exterior grinding chamber.

This effect of loosening up the grinding stock in the interior grinding chamber and thus facilitated flow of the mixture of grinding stock and auxiliary grinding bodies is supported by the elevations which are attached at least to the interior stator and which may be designed as implements, in particular implements in the form of pegs. Thorough swirling of the auxiliary grinding bodies takes place by the elevations or implements attached to the interior stator, which again means intensive strain on the grinding stock. This intensive swirling effect also counteracts any boundary layer at rest to form on the grinding-chamber boundary walls, improving the cooling of the grinding stock.

The development according to which the elevations are disposed helically on the interior stator and the inner wall of the rotor is smooth, free of agitator implements prevents auxiliary bodies from depositing on the inner wall of the rotor; due to the helical arrangement of the implements on the outer casing of the interior stator, the inner wall of the rotor is entirely wiped and thus kept free from deposits.

The further development according to which the interior grinding chamber is followed by a discharge conduit in the shape of a truncated cone which is directed towards the grinding-stock/auxiliary-grinding-body separator device ensures that a certain accumulation effect is exercised on the interior grinding chamber, increasing the dispersing and grinding intensity. This effect can be attained in particular by a further development according to which the discharge conduit is defined by a face, neighbouring the separator device, of the interior stator and a dam-up device. A locally increased auxiliary-grinding-body concentration in the upper end portion can be achieved by such a dam-up device, which again leads to an especially intensive grinding or dispersing effect and thus to very closely distributed grinding-stock particle size. Being a separate component, such a separately incorporated dam-up device can be suited to any concrete application. The gap width of the discharge conduit can be constant in the direction towards the separator device or it may grow.

Fundamentally it is of special advantage when the interior stator is provided with a wearing protection in the vicinity of the discharge conduit, which is particularly advantageous when the gap width of the discharge conduit does not grow towards the separator device i.e., radially inwards, and, consequently, when the cross section of flow is reduced, accompanied with corresponding acceleration of the grinding-stock/auxiliary-grinding-body flow.

The further development, namely of the auxiliary-grinding-body return conduits being formed in an independent auxiliary-grinding-body return module, and in particular of the auxiliary-grinding-body return conduits being open towards a front of the return module, enables the size of the auxiliary-grinding-body return conduits to be adapted to the aims of grinding and dispersing in a simple way. Providing these return conduits in an auxiliary-grinding-body return module enables them to be incorporated laterally into the module, which is particularly simple in terms of implementation. This design also ensures the auxiliary-grinding-body return conduits to be provided with any desired contours by simple manufacturing steps. This simple fabrication also ensures the cross sections of flow of the auxiliary-grinding-body return channels to be optimized in their course from the inside out, with optimal ranges of the relationship of widths of the inlets and outlets consisting in that the return conduits have an inlet of a width c and an outlet of a width d, wherein $d>c$, and preferably $d \geqq 1.5\ c$, applies to the width c of the inlet in relation to the width d of the outlet. With the height of the auxiliary-grinding-body return conduits being kept comparatively small in the direction of the central longitudinal axis, the risk of auxiliary grinding bodies shooting flow can be reduced without excellent separation of the auxiliary grinding bodies from the grinding stock being affected. In this regard, optimal marginal conditions reside in that the auxiliary-grinding-body return conduits have a height e and the grinding-stock/auxiliary-grinding-body separator device has a height f—each in the direction of the central longitudinal axis; and in that $e \leqq f$, and preferably $e<0.5\ f$, applies to the height e in relation to the height f. Those optimal conditions are further improved by the design wherein the return module, in vicinity to the separator device, is provided with wipers which pass continuously without interruption into the return conduits, and wherein the wipers extend along the height f of the auxiliary-grinding-body separator device.

Of course, the design specified above can also be employed by advantage in agitator mills of the generic type which are not embodied for $g<h$ applying to the radial gap width g of the exterior grinding chamber in relation to the radial gap width h of the interior grinding chamber.

Further features and advantages of the invention will become apparent from the ensuing description of exemplary embodiments, taken in conjunction with the drawing.

DESCRIPTION OF PREFERRED EMBODIMENTS

Figure 1:
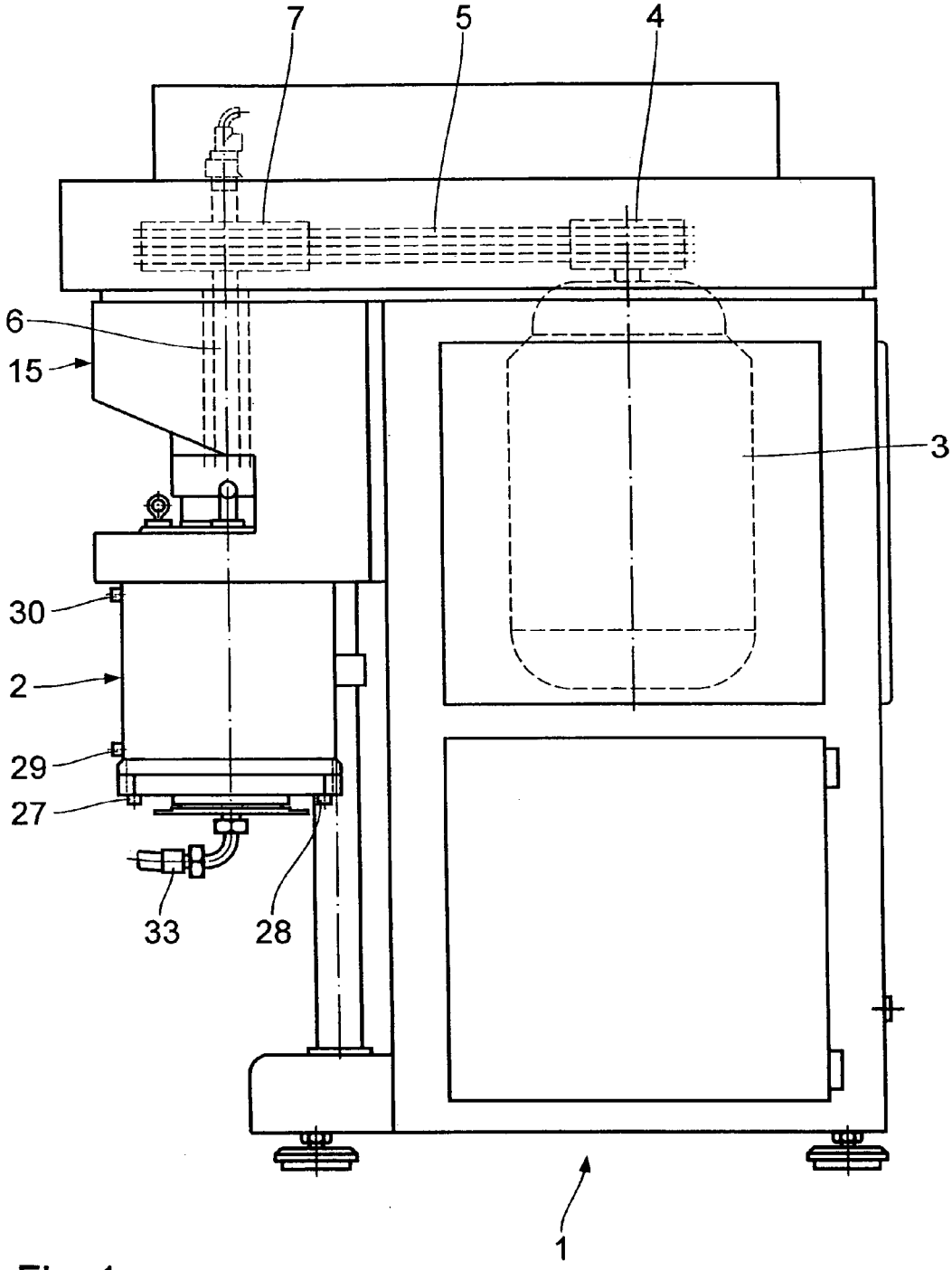
FIG. 1 is a diagrammatic illustration of a side view of an agitator mill.

The agitator mill seen in FIG. 1 conventionally comprises a stand 1 to which to attach a cylindrical grinding receptacle 2. An electric drive motor 3 is housed in the stand 1 and is provided with a V-belt pulley 4 by means of which a V-belt pulley 7, fixed against rotation on a shaft 6, is rotarily drivable.

Figure 2:
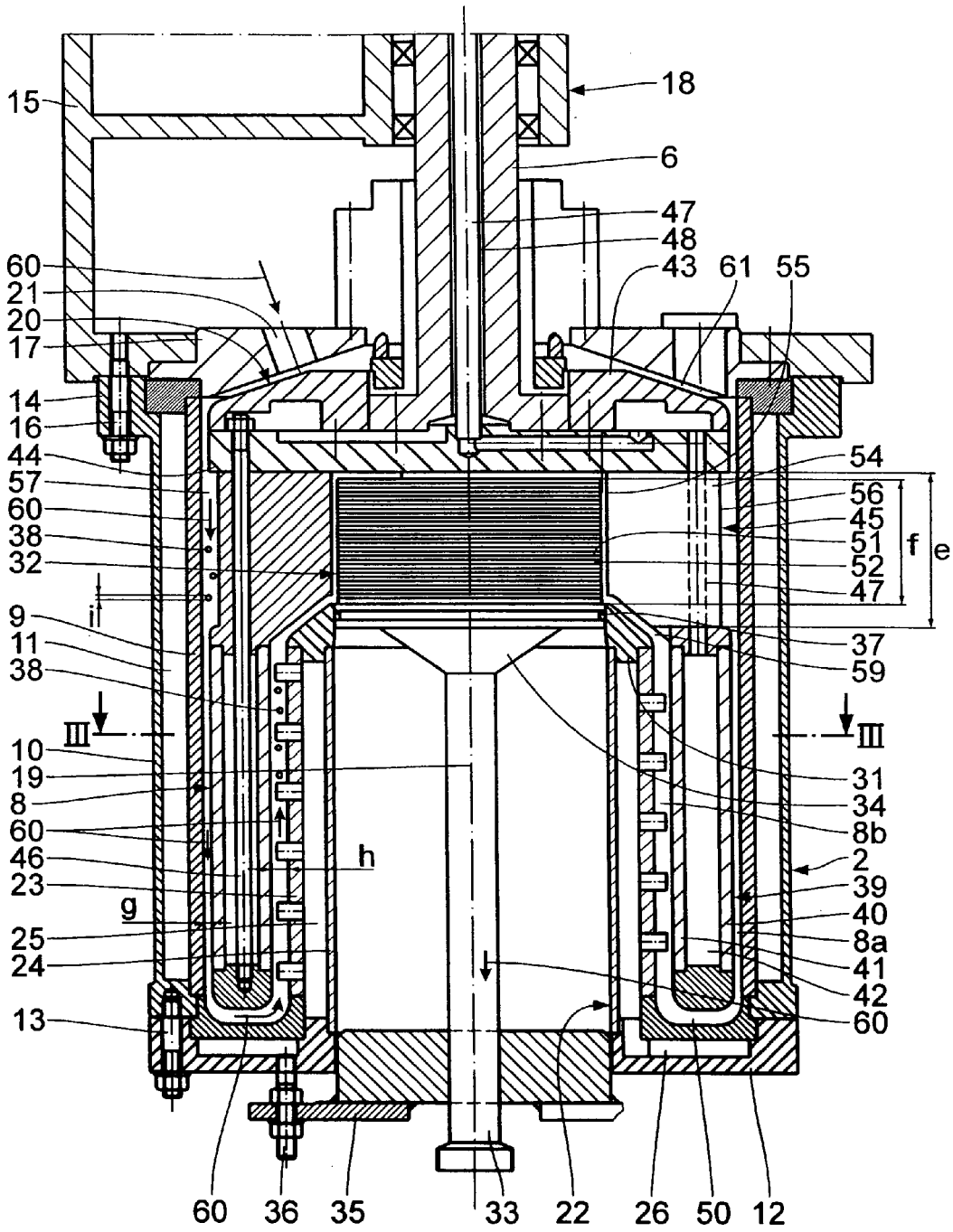
FIG. 2 is a longitudinal sectional view of a first embodiment of a grinding receptacle of the agitator mill.
Figure 3:
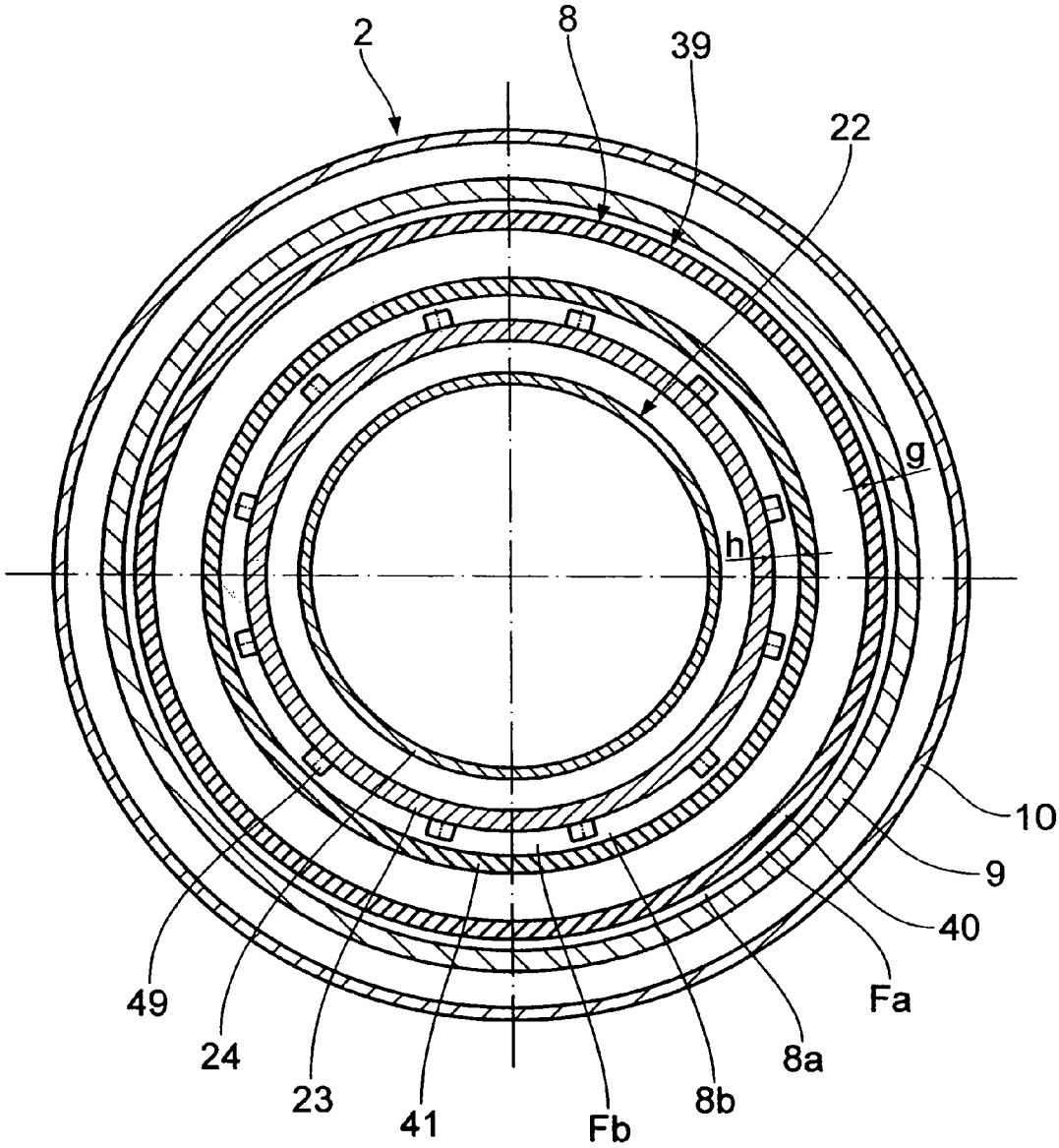
FIG. 3 is a cross-sectional view of the grinding receptacle on the line III—III of FIG. 2.

As shown in particular in FIGS. 2 and 3, the grinding receptacle 2 comprises a cylindrical inner wall 9 which surrounds a grinding chamber 8 and is surrounded by a substantially cylindrical outer casing 10. The inner wall 9 and the outer casing 10 define between each other a cooling chamber 11. The bottom closure of the grinding chamber 8 is formed by a circular bottom plate 12 which is fastened by means of screws 13 to the grinding receptacle 22.

The grinding receptacle 2 has an upper annular flange 14 by means of which is it fixed by screws 16 to the underside of a support housing 15 that is mounted on the stand 1 of the agitator mill. The grinding chamber 8 is closed by a lid 17. The support housing 15 has a central bearing and sealing housing 18 which is disposed coaxially with the central longitudinal axis 19 of the grinding receptacle 2. The bearing and sealing housing 18 is penetrated by the shaft 6 which also extends coaxially with the axis 19 and on which is provided an agitator 20. A grinding-stock supply line 21 opens into the area, adjacent to the grinding chamber 8, of the bearing and sealing housing 18.

An approximately cup-shaped cylindrical interior stator 22 is fixed to the circular bottom plate 12 and projects into the grinding chamber 8; it is comprised of a cylindrical outer casing 23 which is coaxial with the axis 19 and defines the grinding chamber 8; and of a cylindrical inner casing 24 which is also coaxial with the axis 19. Between themselves they define a cooling chamber 25. The cooling chamber 25 is connected with a cooling chamber 26 in the bottom 12, to which cooling water is supplied via a cooling-water supply connector 27 and discharged via a cooling-water discharge connector 28. Cooling water is supplied to the cooling chamber 11 of the grinding receptacle 2 via a cooling-water supply connector 29 and discharged via a cooling-water discharge connector 30.

Disposed on the upper annular face 31, located above the grinding chamber 8, of the interior stator 22 is a grinding-stock/auxiliary-grinding body separator device 32 which is connected with a grinding-stock discharge line 33. Between the separator device 32 and the discharge line 33 provision is made for a grinding-stock collection funnel 34. In the vicinity of the bottom plate 12, the discharge line 33 is provided with a handle 35 which, by means of screws 36, is detachably joined to the bottom plate 12 and, respectively, to the interior stator 22 that is fixedly connected thereto. The separator device 32 is sealed towards the annular face 31 of the interior stator 22 by means of a seal 37 and, together with the discharge line 33 and the collection funnel 34, can be pulled downwards out of the interior stator 22 once the screws 36 have been loosened. The separator device 32 can be removed from the grinding chamber 8 without the auxiliary grinding bodies 38 in the grinding chamber 8 having to be removed therefrom, because, with the agitator 20 not being driven, the level to which the grinding chamber 8 is filled with these auxiliary grinding bodies 38 does not extend to the face 31.

The basic structure of the agitator 20 is cup-shaped i.e., it has a substantially annular cylindrical rotor 39. The rotor 39 has a cylindrical outer wall 40 and a cylindrical inner wall 41 which is disposed coaxially there-with and coaxially with the axis 19. The outer wall 40 and the inner wall 41 are smooth, forming closed surfaces and consequently not exhibiting any interruptions. A cooling chamber 42 is formed between the outer wall 40 and the inner wall 41 of the rotor 39.

The top end of the agitator 20 is provided with a lid-type closing member 43, with a closing plate 44 being fixed to the underside thereof that is turned towards the rotor 39. The closing member 43 and the closing plate 44 are mounted on the shaft 6.

An auxiliary-grinding-body return module 45 is disposed between the rotor 39 and the closing plate 44 of the agitator 20. The rotor 39, the return module 45 and the closing plate 44 are detachably united by means of tie rods 46. The supply and discharge of cooling water to the cooling chamber 42 takes place via cooling-water conduits 47, 48 formed in the shaft 6 and in the return module 45.

An exterior grinding chamber **8*a* is formed by the smooth design of the inner wall 9 of the grinding receptacle 2, which does not possess any implements, and the equally smooth design of the outer wall 40 of the rotor 39. The smooth-walled design, also free of implements, of the inner wall 41 of the rotor 39 and the outer casing 23 of the interior stator 22 define an interior grinding chamber 8*b*. Elevations in the form of peg-style implements 49 that are mounted on the outer casing 23 of the interior stator 22 extend into this interior grinding chamber 8*b*; as seen in particular in FIG. 4, they are arranged helically along the circumference and length of the outer casing 23. As seen in particular in FIG. 4, implements 49 which adjoin in the peripheral direction of the interior stator 22 overlap in the direction of the central longitudinal axis 19 so that, upon rotation of the rotor 39, the inner wall 41 thereof will be wiped entirely by the implements 49**.

As seen above, the grinding chamber 8 is divided into a cylindrical exterior grinding chamber **8*a* on the one hand and a cylindrical interior grinding chamber 8*b* on the other, these chambers being interconnected in vicinity to the bottom plate 12 by a deflection chamber 50** which expands steadily from the outside inwards.

Figure 4:
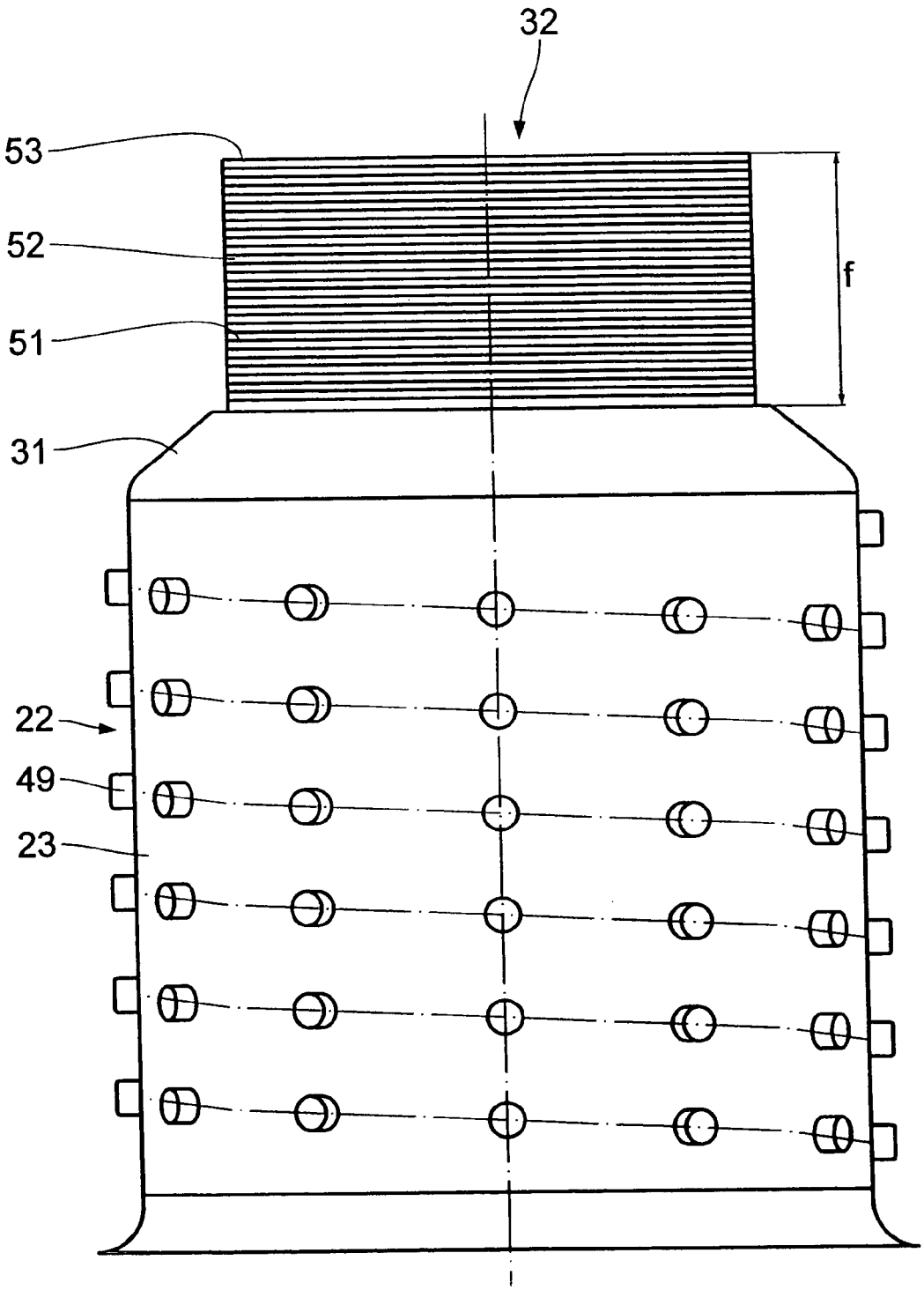
FIG. 4 is a longitudinal side view of an interior stator of the agitator mill.

As seen in FIGS. 2 and 4, the cylindrical separator device 32 is comprised of a stack of annular disks 51, between each of which a separating gap 52 has been left, the width of which is less than the diameter of the smallest auxiliary grinding bodies 38 used; however, the width may also exceed it, separation of the auxiliary grinding bodies 38 taking place before the separator device 32 has been reached. The stack of annular disks 51 is closed off frontally i.e., on the side turned towards the closing plate 44, by a closing plate 53. The separator device 32 is disposed within the return module 45.

Figure 5:
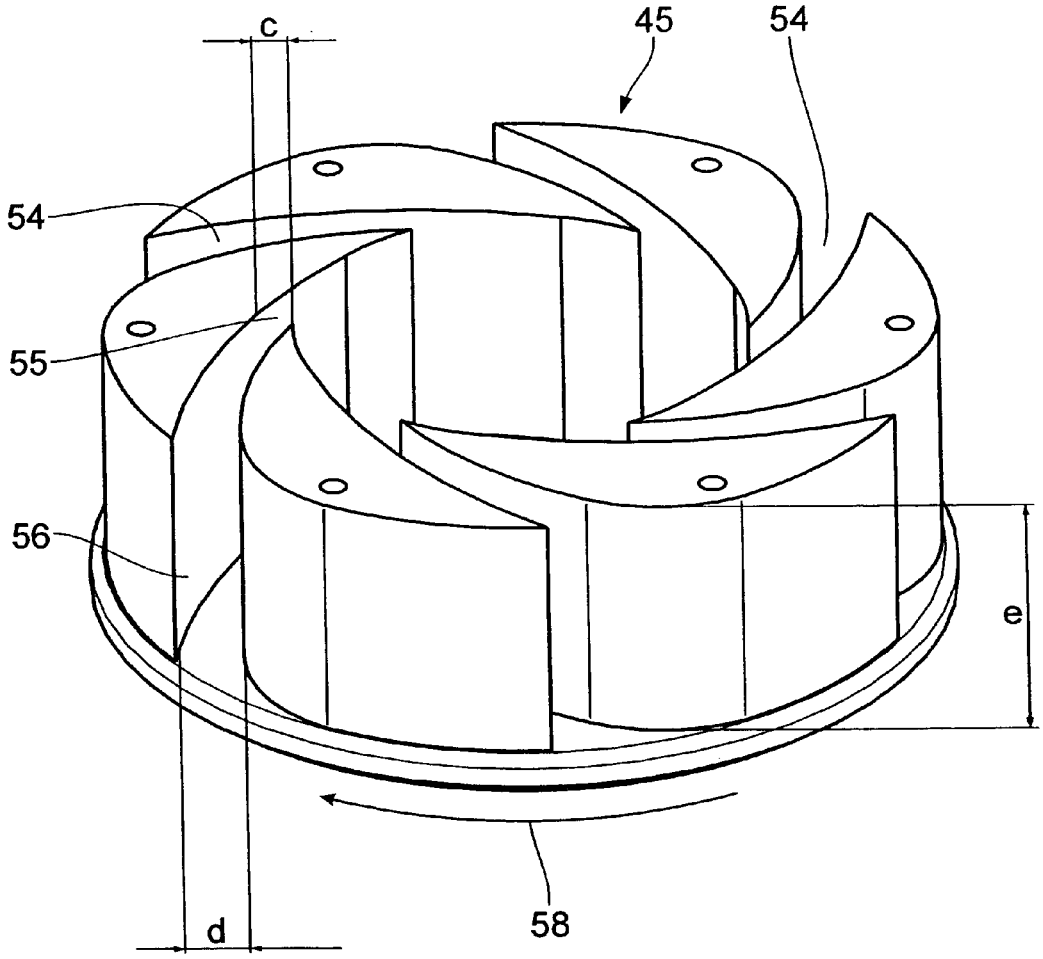
FIG. 5 is a perspective view of an auxiliary-grinding-body return module of the agitator mill according to FIGS. 2 to 4.

As seen in FIGS. 2 and 5, the auxiliary-grinding-body return module 45 is provided with auxiliary-grinding-body return conduits 54. Their respective inlet 55 directly adjoins the separator device 32. Their respective outlet 56 discharges into an annular cylindrical grinding-stock supply area 57 which is formed between the return module 45 and the inner wall 9 of the grinding receptacle 2. The return conduits 54 have their minimum width c at the inlet 55 and their maximum width d at the outlet 56, with the widths c and d being respectively measured in the peripheral direction. From the inlet 55 towards the outlet 56, the return conduits 54 are curved counter to the direction of rotation 58 of the agitator 20, namely convexly from the inside outwards. As for the width c in relation to the width d, $d>c$ applies, and preferably $d \geqq 1.5\ c$.

In the embodiment according to FIGS. 2 to 5, the return conduits 54 extend in the direction of the axis 19 nearly along the total height of the return module 45, their axial height e exceeding the axial height f of the separator device 32. In this embodiment, the return conduits 54, apart from extending across the separator device 32 in the direction of the axis 19, also reach across a discharge conduit 59 leading from the top end of the interior grinding chamber **8*b* obliquely upwards and inwards to the separator device 32 i.e., tapering in the shape of a truncated cone in the direction towards the closing plate 44. In this embodiment, the return conduits 54 are open also towards the discharge conduit 59 as seen in FIG. 2. Consequently, the discharge conduit 59 is not spatially defined upwards. Rather, it is open in the direction of the central longitudinal axis 19 towards the interior grinding chamber 8*b*, leaking auxiliary grinding bodies 38 while the grinding stock flows through the discharge conduit 59 in the direction towards the separator device 32**.

The grinding stock flows through the grinding chamber 8 in accordance with the arrows of flow direction 60, passing from the grinding-stock supply line 21 through a grinding-stock supply chamber 61 between the closing member 43 of the agitator 20 on the one hand and the lid 17 and the adjacent area of the inner wall 9 on the other hand, through the grinding-stock supply area 57, through the exterior grinding chamber 8*a* downwards, radially inwards through the steadily expanding deflection chamber 50 and from there through the interior grinding chamber 8*b* upwards to the discharge conduit 59 and from there to the separator device 32. On its way through the exterior grinding chamber 8*a*, the deflection chamber 50 and the interior grinding chamber 8*b*, the grinding stock is being ground with the agitator 20 being rotarily driven in cooperation with the auxiliary grinding bodies 38. The grinding stock leaves the interior grinding chamber 8*b* via the separator device 32, from where it flows off through the grinding-stock discharge line 33.

As seen in particular from FIG. 2, the radial gap width g of the exterior grinding chamber 8*a* is distinctly less than the radial gap width h of the interior grinding chamber 8*b*. The relationship of the gap widths g and h to each other is such that the cross-sectional area Fb of the interior grinding chamber 8*b* equals or exceeds the cross-sectional area Fa of the exterior grinding chamber 8*a*. The exterior grinding chamber 8*a* as well as the interior grinding chamber 8*b* are designed as grinding gaps. As for the gap width g of the exterior grinding chamber 8*a* in relation to the diameter i of the biggest auxiliary grinding bodies 38 in the agitator mill, the following applies:

$g \geqq 3\ i$, with $i \leqq 3.0$ mm, and preferably $i \leqq 1.5$ mm, applying to the diameter i.

As for the gap width g of the exterior grinding chamber 8*a*, $g \leqq 9.0$ mm, and preferably $g \leqq 5.0$ mm, applies absolutely.

As for the cross-sectional area Fa of the exterior grinding chamber 8*a* in relation to the cross-sectional area Fb of the interior grinding chamber 8*b*: $Fa \leqq Fb$ applies, and preferably $1.2\ Fa \leqq Fb \leqq 7\ Fa$.

Figure 6:
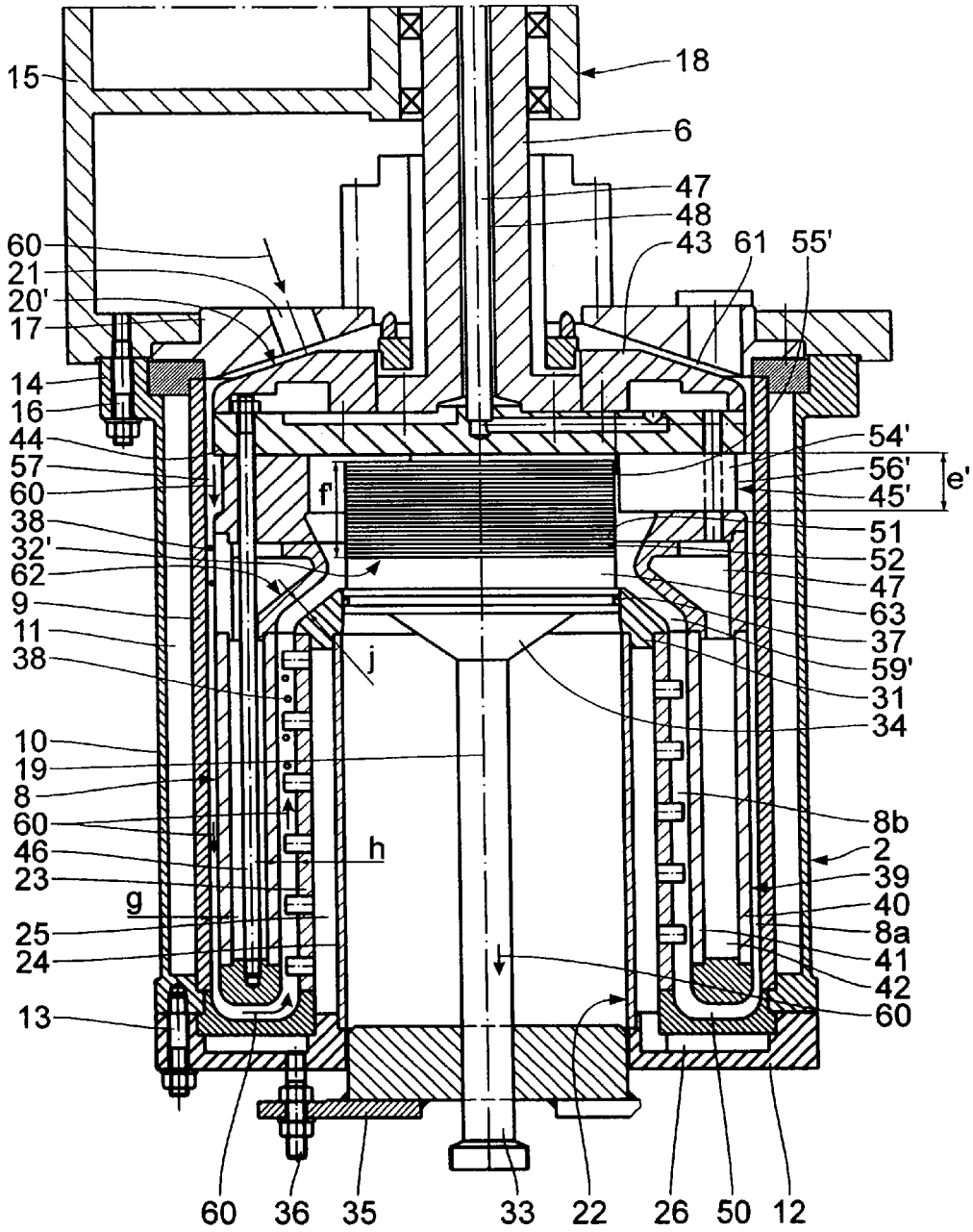
FIG. 6 is a longitudinal sectional view of a second embodiment of a grinding receptacle of the agitator mill.
Figure 7:
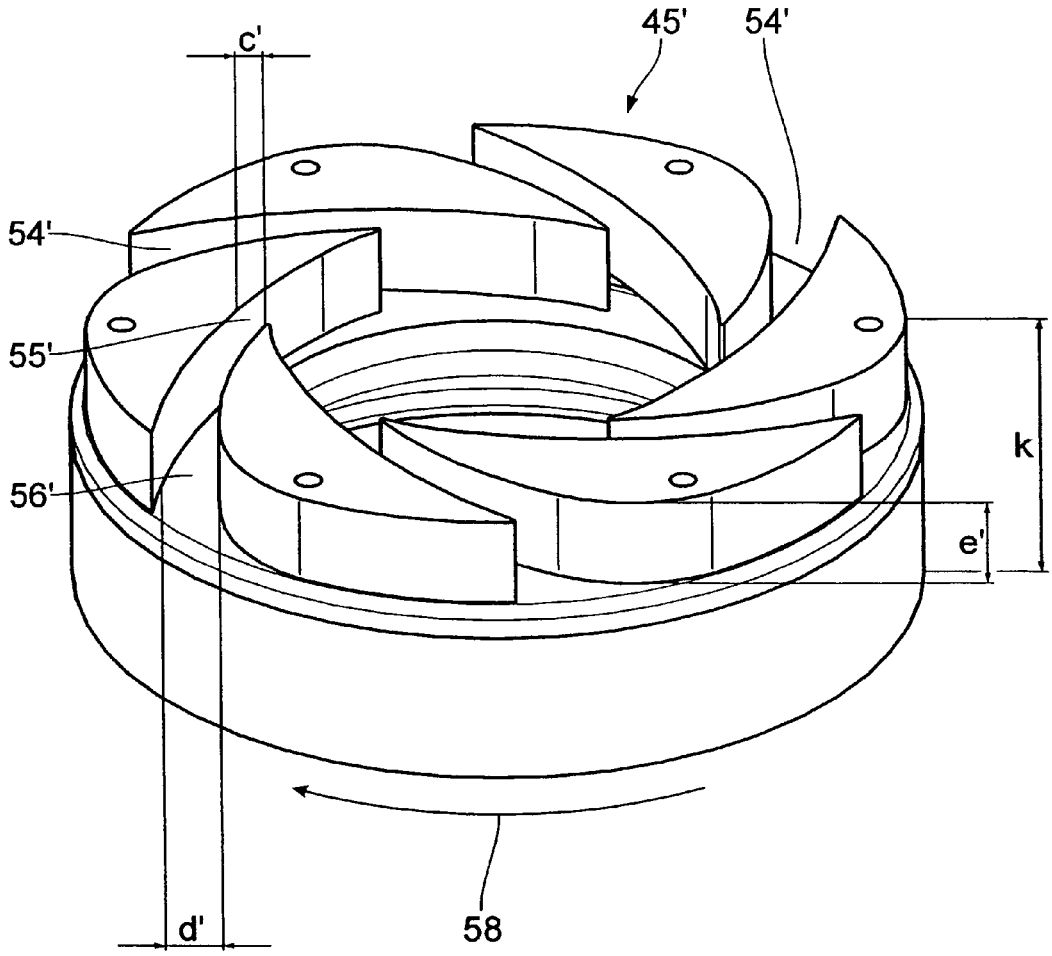
FIG. 7 is a perspective view of the auxiliary-grinding-body return module of the agitator according to FIG. 6.

The embodiment of FIGS. 6 and 7 differs from that of FIGS. 2 to 5 substantially in that, in addition to an auxiliary-grinding-body return module 45', a dam-up device 62 is provided as part of the agitator 20' between the closing plate 44 and the rotor 39. The discharge conduit 59' is defined between the face 31 of the interior stator 22 and this dam-up device 62 so that, by variation of the embodiment of FIGS. 2 to 5, it is defined not only at its underside by the face 31, but also at its top side by the dam-up device 62. Other than in the embodiment of FIGS. 2 to 5, the interior grinding chamber 8*b* does not discharge by its top end directly into the return conduits 54', but the mixture of grinding stock and auxiliary grinding bodies is forcibly deviated by the dam-up device 62 in a direction obliquely upwards and inwards towards the separator device 32'. The gap width j of the discharge conduit 59' is constant in this embodiment.

In as much as parts are identical with those of the embodiment according to FIGS. 2 to 5, the same reference numerals are used. Functionally identical and constructionally similar parts have the same reference numerals with a prime added. The same applies to further embodiments with a correspondingly higher number of primes. The height e' of the return conduits 54' is clearly inferior to the height e in the embodiment of FIGS. 2 to 5. Furthermore the height e' is clearly inferior to the axial height f' of the separator device 32'. This is a simple way of ensuring that the height e' of the return conduits 54' can be adapted to reduced grinding-stock throughputs and that the risk of grinding-stock-particle shooting flow can additionally be reduced, in particular in the case of little grinding-stock throughput or a low speed of the agitator 10. It applies:

$e' \leqq f'$ and in particular $e' \leqq 0.8\ f'$ and especially $e' \leqq 0.5\ f'$.

Furthermore, the separator device 32' does not extend across the entire area above the face 31. Rather, a closed annular section is provided as a wearing protection 63 between the face 31 and the separator device 32'; the wearing protection 63 and the separator device 32' are one piece. The discharge conduit 59' ends ahead of, or at, the wearing protection 63 so that any auxiliary grinding bodies 38, leaking from the discharge conduit 59' and being deflected into a motion parallel to the axis 19, do not hit the separator device 32'.

Figure 8:
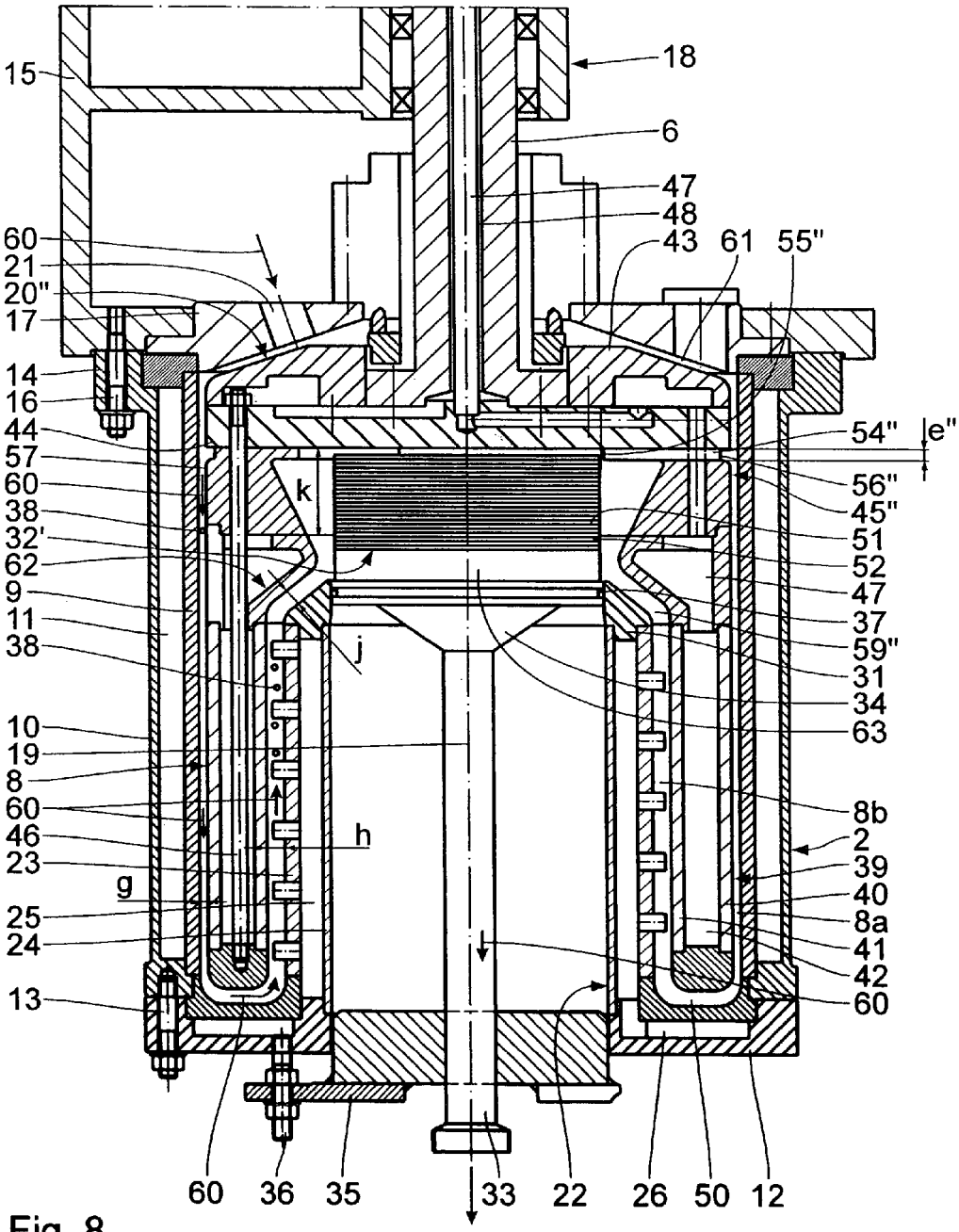
FIG. 8 is a longitudinal sectional view of a third embodiment of a grinding receptacle of the agitator mill.

The embodiment according to FIG. 8 differs from that of FIGS. 6 and 7 only in that the auxiliary-grinding-body return conduits 54" have a minimum height e" required for trouble-free operation at inferior grinding-stock throughputs. In this case too the auxiliary-grinding-body return module 45" adjoins the dam-up device 62, with the return conduits 54", at their top side, being defined by the closing plate 44 in this embodiment as well as in the two embodiments mentioned above. However the axial height k is the same in the return modules 45' and 45".

As for the minimal axial height e" of the return conduits 54" the following applies: $e'' \geqq 3\ i$, and at least $e'' \geqq 4$ mm.

Figure 9:
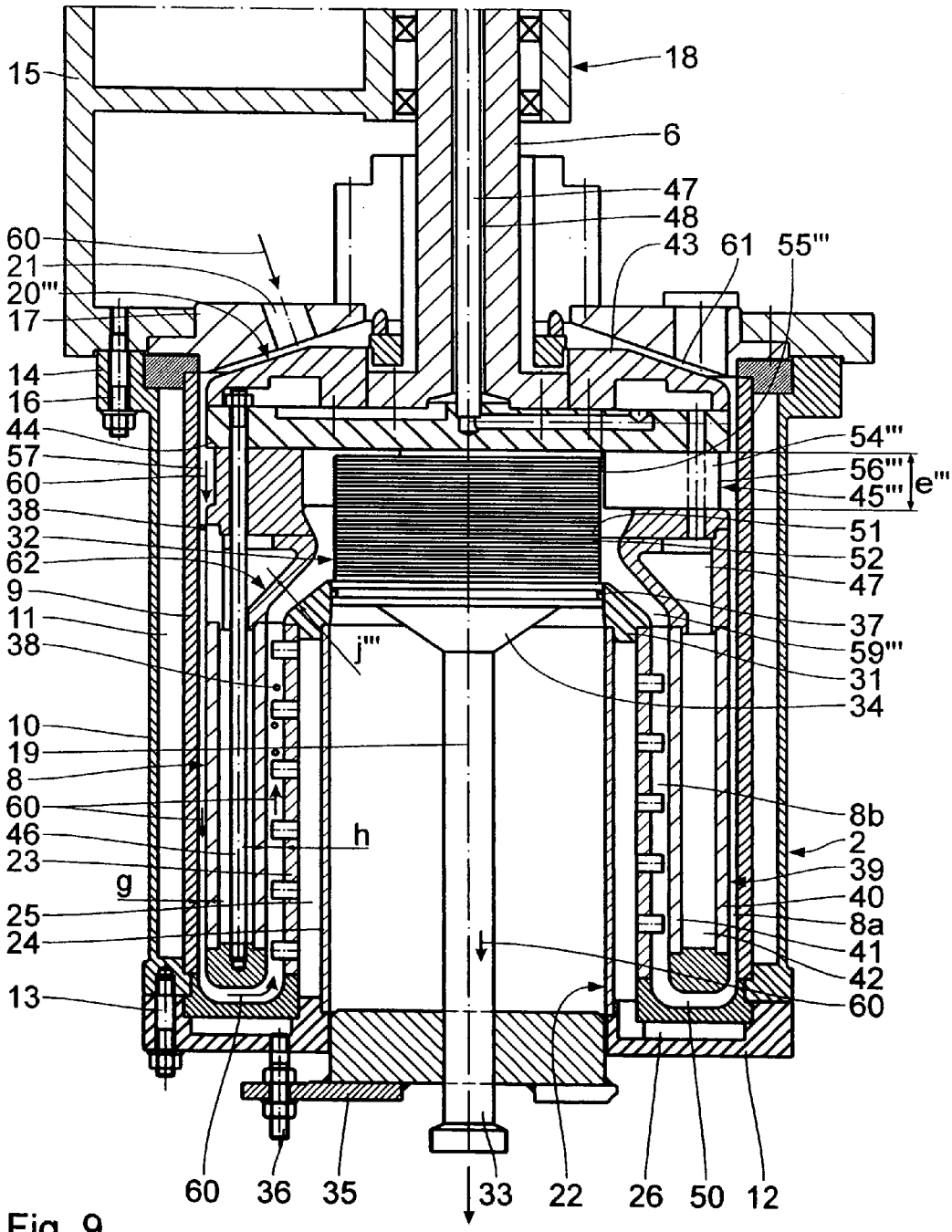
FIG. 9 is a longitudinal sectional view of a fourth embodiment of a grinding receptacle of the agitator mill.

The embodiment according to FIG. 9 corresponds to that of FIG. 6 with the difference residing in that no wearing protection 63 is provided and that the discharge conduits 59''' expand towards the auxiliary-grinding-body separator device 32 i.e., the gap width j''' of the discharge conduit 59''' grows inwards to such an extent that the total cross-sectional area of this conduit 59''' does not decrease in the direction towards the separator device 32 so that no acceleration of the flow of grinding stock and auxiliary grinding bodies takes place in the discharge conduit 59''' towards the separator device 32. For this reason, the separator device 32 can extend as far as to the face 31, because the auxiliary grinding bodies 38 do not hit the separator device 32.

Figure 10:
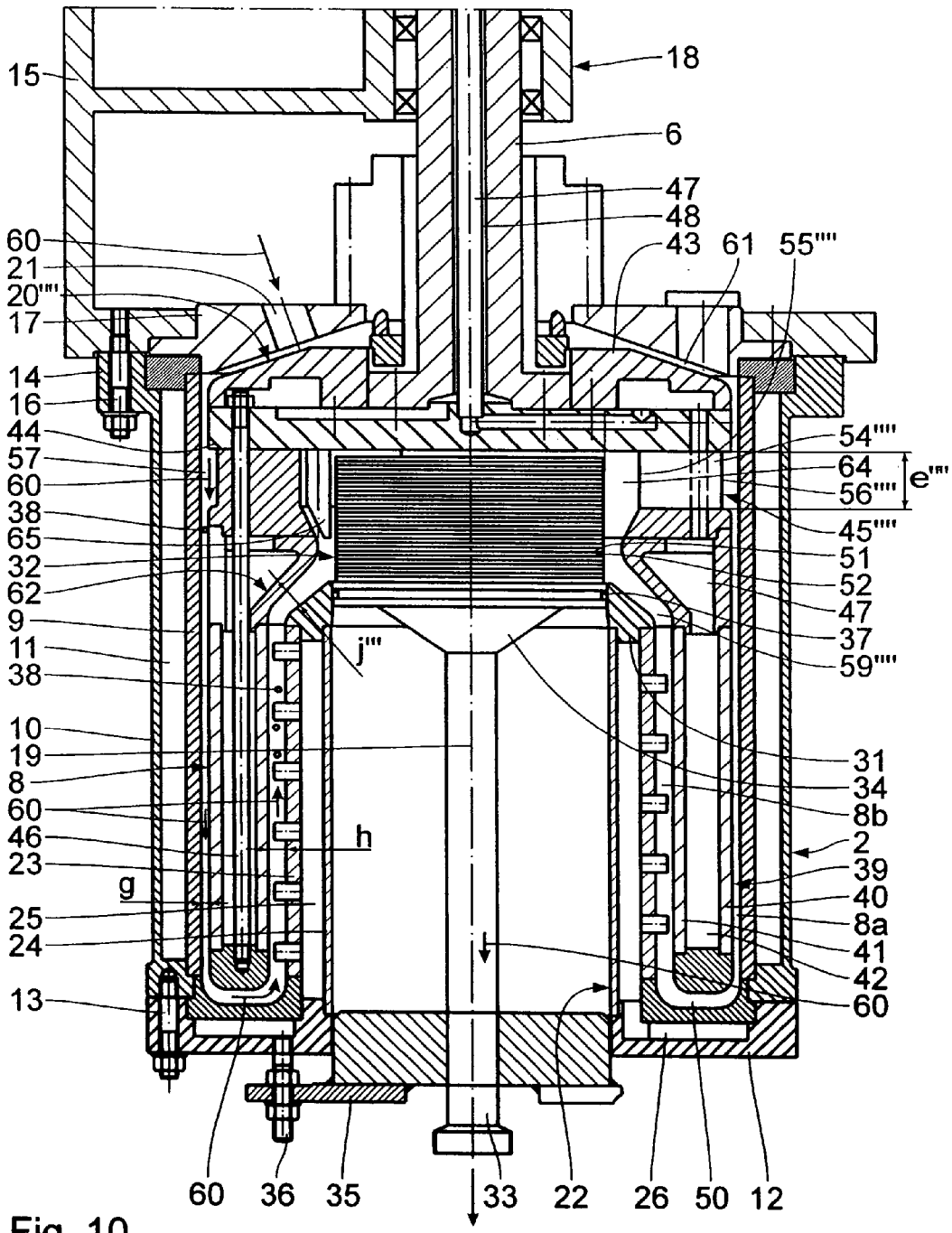
FIG. 10 is a longitudinal sectional view of a fifth embodiment of a grinding receptacle of the agitator mill.

The embodiment according to FIG. 10 substantially corresponds to that of FIG. 9, with the auxiliary-grinding-body return module 45'''' not leading as far as to the separator device 32. The inlets 55'''' of the auxiliary-grinding-body return conduits 54'''' have a clear radial distance from the separator device 32. In this annular chamber 64, provision is made for several wipers 65 which are mounted on the closing plate 44 and rotate together with the agitator 20''''.

Figure 11:
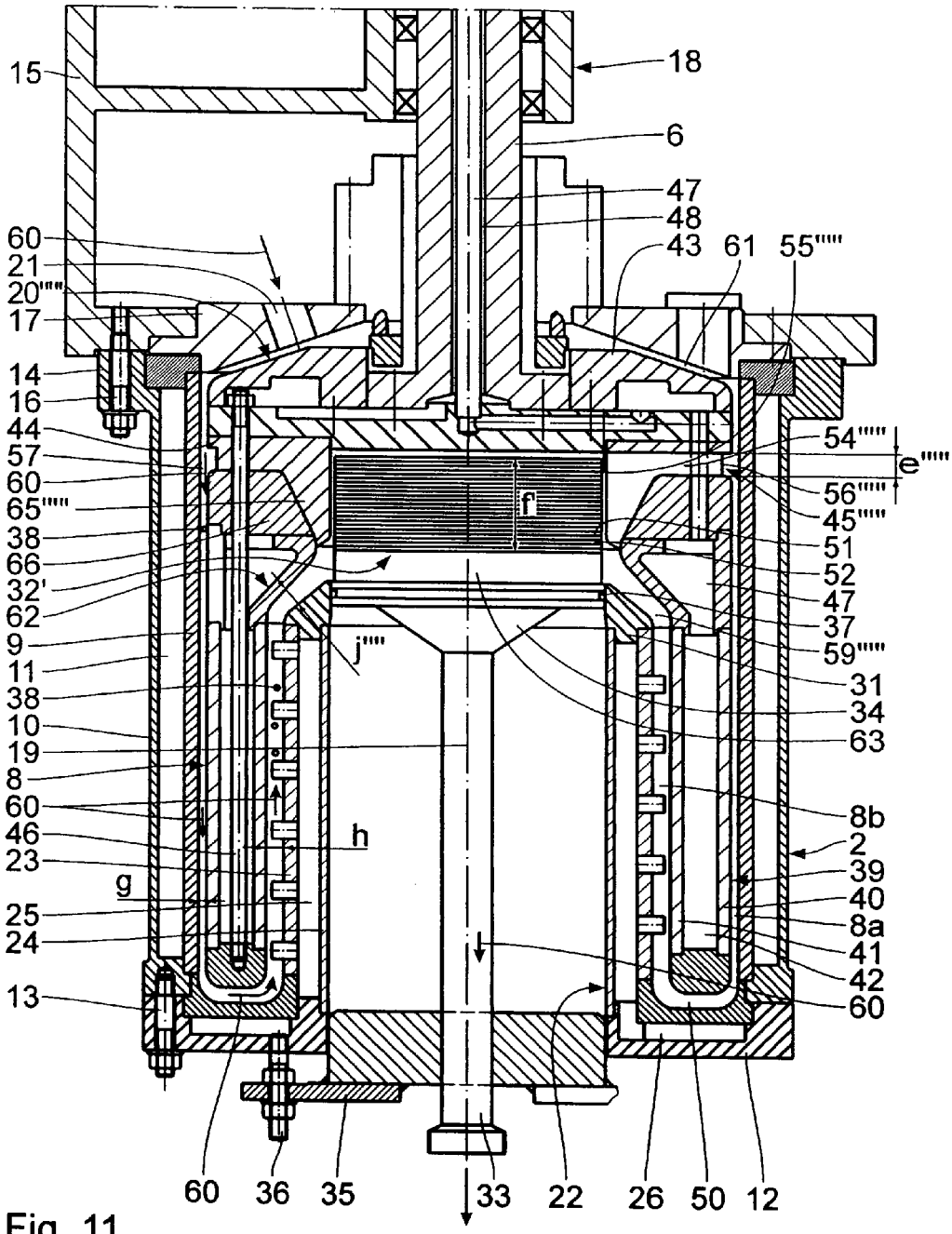
FIG. 11 is a longitudinal sectional view of a sixth embodiment of a grinding receptacle of the agitator mill.
Figure 12:
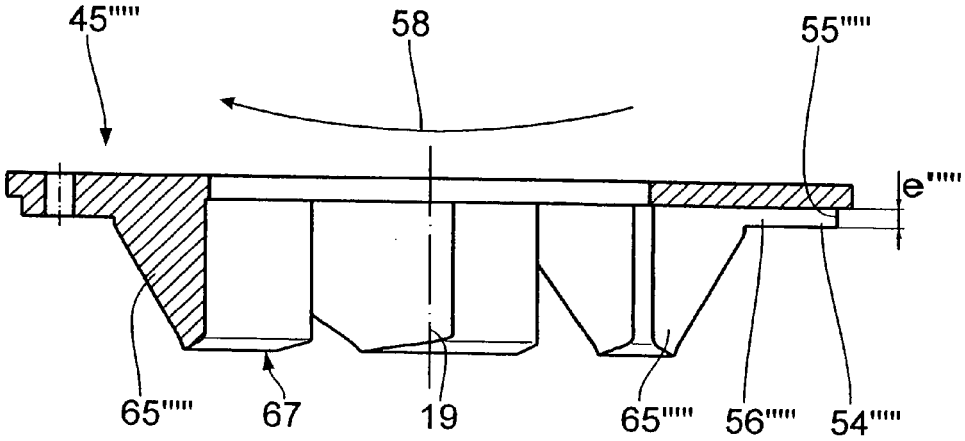
FIG. 12 is a side view of an auxiliary-grinding-body return module of the agitator mill according to FIG. 11.
Figure 13:
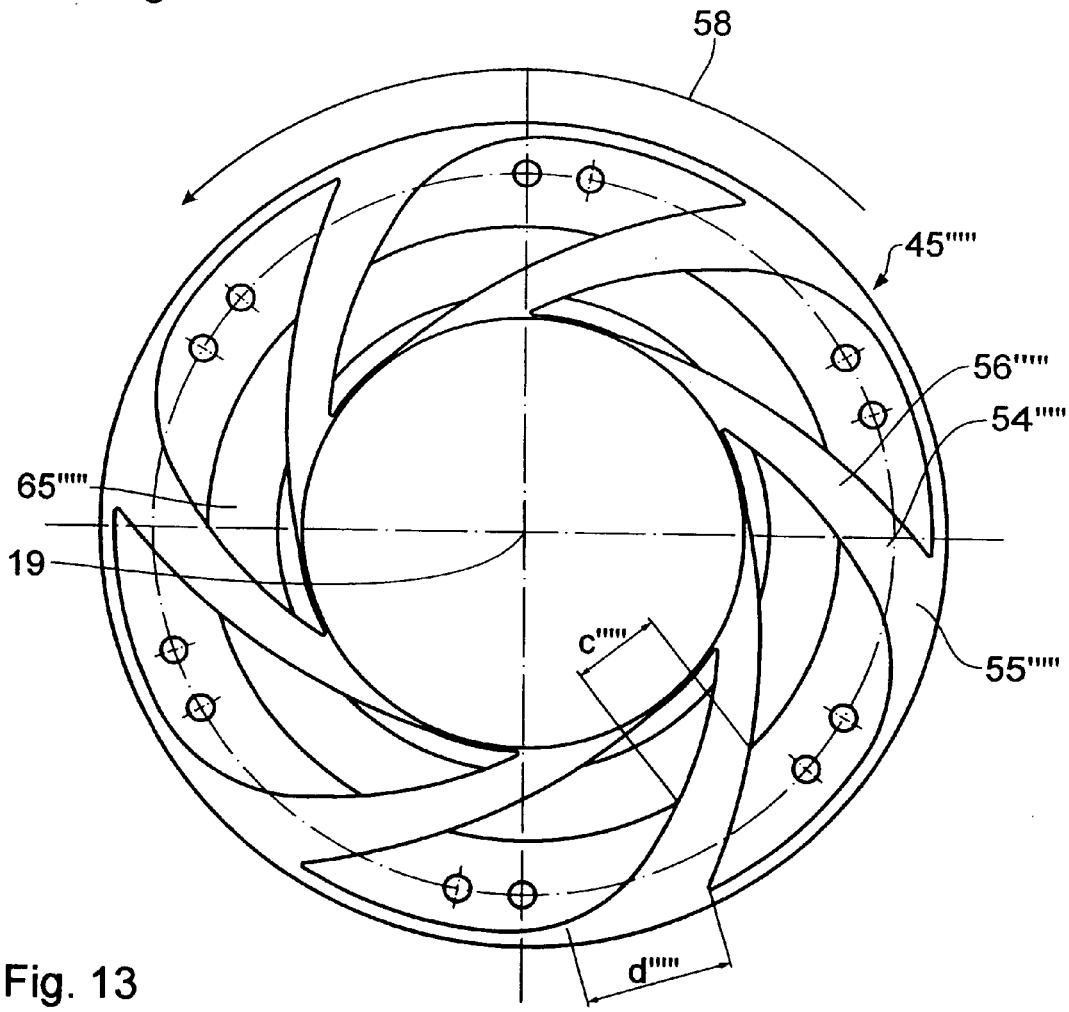
FIG. 13 is a view from below of the auxiliary-grinding-body return module according to FIG. 12.

The embodiment according to FIGS. 11 to 13 comprises an auxiliary-grinding-body return module 45''''' which, towards the dam-up device 62, bears against an intermediate ring 66. The module 45''''' is open downwards towards the grinding chamber 8 i.e., towards a front 67. The axial height e''''' is constant from the respective inlet 55''''' to the outlet 56''''' and distinctly less that the height f' of the separator device 32'. The wipers 65''''' directly adjoin the return conduits 54''''' so that there is a continuous transition from these wipers 65''''' into the return conduits 54''''', as shown in particular in FIG. 13. This leads to optimal flow conditions.

As seen in FIG. 11, the wipers 65'''' extend in the direction of the axis 19 approximately along the height f' of the separator device 32'.

What is claimed is:

1. An agitator mill for treating free-flowing grinding stock, comprising a grinding receptacle (2) which defines a substantially closed grinding chamber (8) by means of an inner wall (9); and an agitator (20) which is rotarily drivably disposed therein and which is cup-shaped in relation to a common central longitudinal axis (19), having an annular cylindrical rotor (39) which has a closed wall (40, 41); and an interior stator (22) which is disposed within the rotor (39) and fixedly joined to the grinding receptacle (2);

wherein an annular cylindrical exterior grinding chamber (8*a*) in the form of an annular gap is formed between the inner wall (9) of the grinding receptacle (2) and an outer wall (40) of the rotor (39), the exterior grinding chamber (8*a*) having a radial gap width g;

wherein an annular cylindrical interior grinding chamber (8*b*) in the form of an annular gap is formed between an inner wall (41) of the rotor (39) and an outer casing (23) of the interior stator (22), the interior grinding chamber (8*b*) being arranged coaxially within the exterior grinding chamber (8*a*) and connected thereto via a deflection chamber (50) and having a radial gap width h;

wherein the exterior grinding chamber (8*a*), the deflection chamber (50) and the interior grinding chamber (8*b*) constitute the grinding chamber (8) which is partially filled with auxiliary grinding bodies (38);

wherein a grinding-stock supply area (57), which is disposed upstream of the exterior grinding chamber (8*a*) and opens into the exterior grinding chamber (8*a*) in the direction of flow (60) of the grinding stock, and a separator device (32), which is disposed downstream of the interior grinding chamber (8*b*) in the direction of flow (60), are disposed approximately on the same side of the grinding receptacle (2) for the grinding stock to pass through;

wherein auxiliary-grinding-body return conduits (54) are provided in the agitator (20) for returning the auxiliary grinding bodies (38) from the vicinity of the separator device (32) into the grinding-stock supply area (57), the return conduits (54) connecting the end of the interior grinding chamber (8*b*) to the beginning of the exterior grinding chamber (8*a*);

wherein the inner wall (9) of the grinding receptacle (2) and the outer wall (40) and the inner wall (41) of the rotor (39) are free of interruptions, and the inner wall (9) of the grinding receptacle (2) and the outer wall (40) of the rotor (39) are smooth and free of agitator implements; and wherein $g<h$ applies to the radial gap width g of the exterior grinding chamber (8*a*) in relation to the radial gap width h of the interior grinding chamber (8*b*).

2. An agitator mill according to claim 1, wherein $Fa \leqq Fb$ applies to the cross-sectional area Fa of the exterior grinding chamber (8*a*) in relation to the cross-sectional area Fb of the interior grinding chamber (8*b*).

3. An agitator mill according to claim 1, wherein $g \leqq 3\ i$ applies to the gap width g of the exterior grinding chamber (8*a*) in relation to the diameter i of the biggest auxiliary grinding bodies (38) in the grinding chamber (8);

wherein $i \leqq 3.0$ mm applies to the diameter i of the auxiliary grinding bodies (38);

and wherein $g \leqq 9.0$ mm applies to the gap width of the exterior grinding chamber (8*a*).

4. An agitator mill according to claim 1, wherein the outer casing (23) of the interior stator (22) is equipped with elevations which project into the interior grinding chamber (8*b*).

5. An agitator mill according to claim 4, wherein the elevations are implements (49).

6. An agitator mill according to claim 4, wherein the elevations are disposed helically on the interior stator (22).

7. An agitator mill according to claim 1, wherein the inner wall (41) of the rotor (39) is smooth, free of agitator implements.

8. An agitator mill according to claim 1, wherein the interior grinding chamber (8*b*) is followed by a discharge conduit (59) in the shape of a truncated cone which is directed towards the separator device (32).

9. An agitator mill according to claim 8, wherein the discharge conduit (59) is defined by a face (31), neighbouring the separator device (32), of the interior stator (22) and a dam-up device (62).

10. An agitator mill according to claim 9, wherein the dam-up device (62) is an independent component part of the agitator (20).

11. An agitator mill according to claim 8, wherein the gap width j of the discharge conduit (59) grows in a direction towards the separator device (32).

12. An agitator mill according to claim 8, wherein the interior stator (22) is provided with a wearing protection (63) in the vicinity of the discharge conduit (59).

13. An agitator mill according to claim 1, wherein the auxiliary-grinding-body return conduits (54) are formed in an independent auxiliary-grinding-body return module (45).

14. An agitator mill according to claim 13, wherein the auxiliary-grinding-body return conduits (54) are open towards a front (67) of the return module (45).

15. An agitator mill according to claim 1, wherein the return conduits (54) have an inlet (5) of a width c and an outlet (56) of a width d; and wherein $d>c$ applies to the width c of the inlet (55) in relation to the width d of the outlet (56).

16. An agitator mill according to claim 1, wherein the auxiliary-grinding-body return conduits (54) have a height e and the separator device (32) has a height f—each in the direction of the central longitudinal axis (1); and wherein $e \leqq f$ applies to the height e in relation to the height f.

17. An agitator mill according to claim 13, wherein the return module (45), in vicinity to the separator device (32), is provided with wipers (65) which pass continuously without interruption into the return conduits (54).

18. An agitator mill according to claim 17, wherein the wipers (65) extend along the height f of the auxiliary-grinding-body separator device (32).

19. An agitator mill according to claim 2, wherein $1.2\ Fa \leqq Fb \leqq 7\ Fa$ applies to the cross-sectional area Fa of the exterior grinding chamber (8*a*) in relation to the cross-sectional area Fb of the interior grinding chamber (8*b*).

20. An agitator mill according to claim 3,
wherein $i \leqq 1.5$ mm applies to the diameter i of the auxiliary grinding bodies (38).

21. An agitator mill according to claim 3,
wherein $g \leqq 5.0$ mm applies to the gap width of the exterior grinding chamber (8*a*).

22. An agitator mill according to claim 4,
wherein the implements (49) are in the form of pegs.

23. An agitator mill according to claim 15,
wherein $d \geqq 1.5$ c applies to the width c of the inlet (55) in relation to the width d of the outlet (56).

24. An agitator mill according to claim 16,
wherein $e < 0.5$ f applies to the height e in relation to the height f.

* * * * *